United States Patent [19]

Gustmann et al.

[11] Patent Number: 4,572,091

[45] Date of Patent: Feb. 25, 1986

[54] FREELY REVOLVING LOOPER FOR DOUBLE LOCKSTITCH SEWING MACHINES

[75] Inventors: Kurt Gustmann, Kaiserslautern; Siegard Brandt, Stelzenberg; Ludwig Sourisseaux, Ramstein-Miesenbach, all of Fed. Rep. of Germany

[73] Assignee: Pfaff Aktiengesellschaft, Fed. Rep. of Germany

[21] Appl. No.: 553,065

[22] Filed: Nov. 18, 1983

[30] Foreign Application Priority Data

Dec. 4, 1982 [DE] Fed. Rep. of Germany ..... 3244946

[51] Int. Cl.[4] ..... D05B 57/26

[52] U.S. Cl. ..... 112/229; 112/231

[58] Field of Search ..... 112/181, 182, 228, 229, 112/230, 231

[56] References Cited

U.S. PATENT DOCUMENTS

| | | | |
|---|---|---|---|
| 1,019,208 | 3/1912 | Wardwell | 112/228 X |
| 1,467,898 | 9/1923 | Kiewicz | 112/181 |
| 1,504,242 | 8/1924 | Hohmann | 112/228 |
| 1,794,255 | 2/1931 | Stephenson | 112/181 |
| 2,941,488 | 6/1960 | Attwood | 112/228 |
| 4,284,017 | 8/1981 | Starr | 112/181 |

FOREIGN PATENT DOCUMENTS

| | | | |
|---|---|---|---|
| 409771 | 3/1925 | Fed. Rep. of Germany | 112/231 |
| 597089 | 8/1959 | Italy | 112/228 |

*Primary Examiner*—Wm. Carter Reynolds
*Attorney, Agent, or Firm*—McGlew and Tuttle

[57] ABSTRACT

A rotary hook for a sewing machine has a rotatable hook drive shaft driving a hook body in cooperation with a reciprocating needle which moves toward and away from the rotary hook. The hook body has a revolving rotary hook tip which is movable in a path relative to the needle and is engageable with the thread presented by the needle. The rotary hook includes a thread deflecting shoulder to enlarge the thread to form a needle thread loop, includes a case holder having an annular guide rib and a pin extending axially outwardly of the holder. A bobbin case has a central hollow sleeve into which the pin extends and a latch engageable with the pin to hold the case holder to the bobbin case. The case each holder and the bobbin case have a sidewall with interiors which are in substantial alignment. The bobbin case holder has a rearwall formed as a substantially truncated cone which is eccentric to the guide rib and the bobbin case has an annular sidewall and a frontwall have an arched mushroom shape. The bobbin case holder and the bobbin case are fitted together, not telescopingly, but on the pot-and-lid principle.

1 Claim, 14 Drawing Figures

Fig. 4
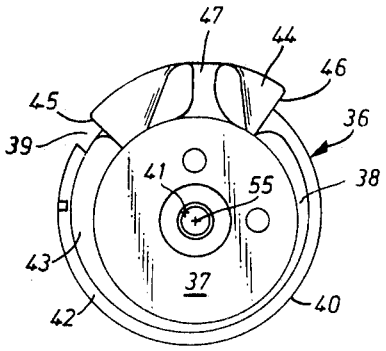
Fig. 6
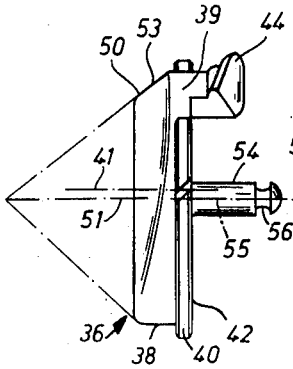
Fig. 7
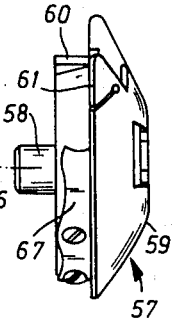
Fig 5
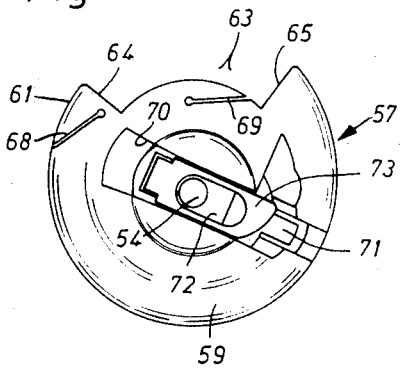
Fig. 8
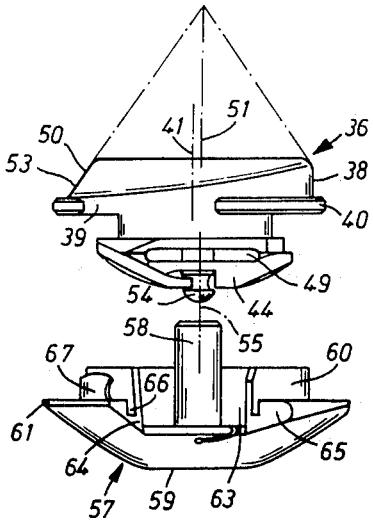
Fig. 9
Fig. 10
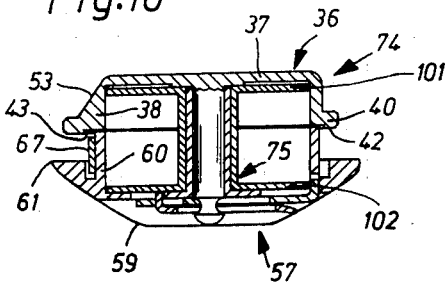

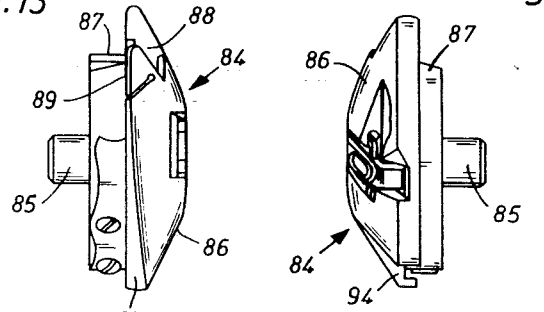
Fig. 14
Fig. 13
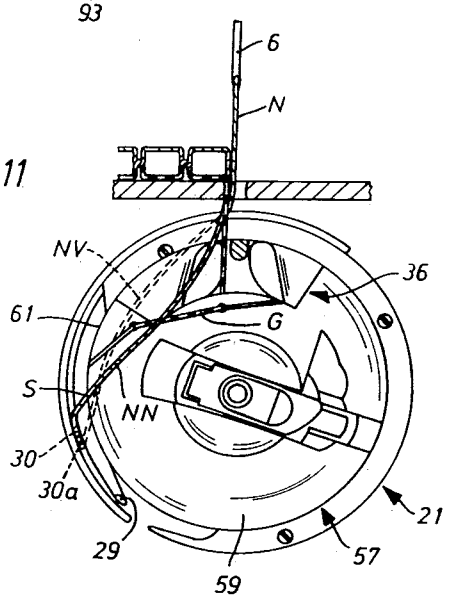
Fig. 11
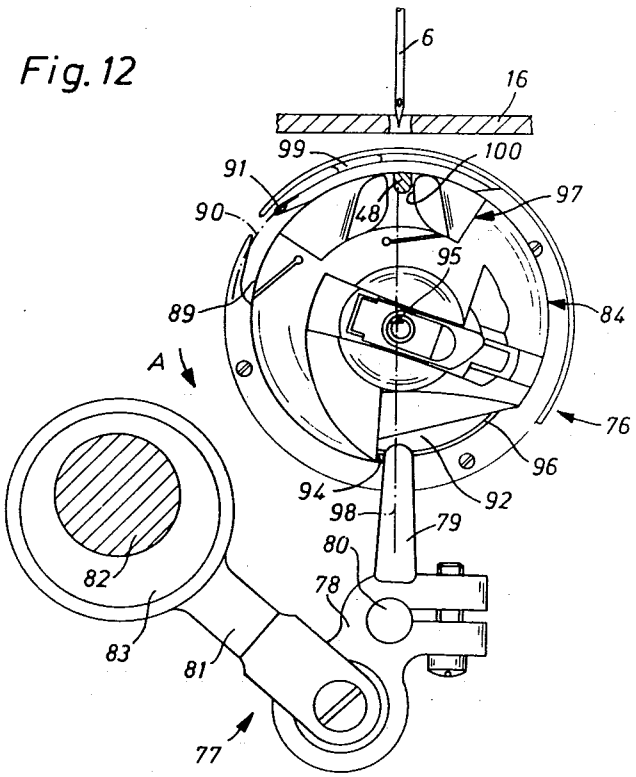
Fig. 12

FREELY REVOLVING LOOPER FOR DOUBLE LOCKSTITCH SEWING MACHINES

FIELD AND BACKGROUND OF THE INVENTION

This invention relates in general to sewing machines and in particular to a new and useful rotary hook construction for such sewing machines.

A rotary hook construction can be seen from German Pat. No. 409,771. In the known rotary hook thread uptake capacity is to be increased, combined with good sewing properties at high sewing speed, in that the pin of the bobbin case holder is arranged displaced downward relative to the axis of the guide rib of the bobbin case holder and at the same time also laterally by cutting away a part of the sidewall of the bobbin case holder. Due to the eccentric arrangement of the bobbin case, obliquely at the lower right as seen in a front view on the rotary hook, the bobbin can be made larger than conventional bobbins in radial as well as in axial directions. The eccentric arrangement of the bobbin case is intended further to permit sufficiently small edge angles between the bevels on the front and back of the bobbin case holder, thereby facilitating the spreading of the needle thread loop as it is being passed around the bobbin case holder and the bobbin case.

This rotary hook, as it has been known in the literature for many decades, wherein normally conflicting properties, namely great rotary hook thread uptake capacity as well as good sewing properties at high sewing speed are optimized in an apparently ideal manner, but evidently does not have the desired good sewing properties after all, since it has not been proved in practice. In fact, for the modern high speed sewing units with automatic work feed control the machine down times caused by bobbin change are especially disrupting. Since the need for a double lockstitch rotary hook with great thread uptake capacity combined with good sewing property at high sewing speed is nowadays especially great; so far entirely different methods, but also unsatisfactory ones in the last analysis, have been followed to achieve this objective.

Increasing the size of the normal rotary hook as a whole is known. But this leads to the disadvantage that the rotary hook shaft must be placed lower, and that a thread feeder of a different characteristic, and possibly a modified case lifter and a different thread cutting device must be used. These consequent measures, however, conflict with the general trend toward reduction of diversity and the application of the principle of modular construction. Moreover, the larger rotary hook pulls more needle thread under the throat plate as the needle thread loop is being laid around the bobbin case holder than is the case with normal rotary hooks. The result is that the individual sections of the needle thread are pulled through the eye of the needle much more often and hence there is much more stress on the needle thread than in normal rotary hooks.

The rotary hook for double lockstitch sewing machines known from German OS No. 29 53 743 (U.S. Pat. No. 4,284,017) is based on an entirely different principle for enlarging the rotary hook thread uptake capacity. For this rotary hook one uses instead of a two-part bobbin case housing a one part pot type bobbin holder with a central pin for direct uptake of the bobbin. The bobbin fills the entire cavity of the bobbin holder, owing to which its diameter is increased by twice the wall thickness of the eliminated bobbin case. The front flange of the bobbin is made convex and forms the end wall of the rotary hook. The bobbin is retained axially either by a spring loaded lever which is disposed at the hollow pin and applies against the front flange, or by permanent magnets inserted in the bottom of the bobbin holder. The threaded tension at the rotary hook thread is produced by the friction between the bobbin and the rotary hook surfaces surrounding the bobbin on the end face, that is, in one case by the bottom of the bobbin holder and in the other additionally by the lever.

The increased rotary hook thread uptake capacity and simplified construction of this rotary hook are offset, however, by the major disadvantage that as the amount of thread on the bobbin diminishes, the thread tension on the rotary hook thread increases continuously; so that, because of the continually varying ratio between the needle thread tension and the rotary hook thread tension, a different stitch pattern results on relatively long seams.

SUMMARY OF THE INVENTION

The invention provides a looper which has a high thread uptake capacity and yet good sewing properties and which requires a minimum of changes on the sewing machine.

By letting the inner side of the sidewall of the bobbin case holder be aligned with the inner side of the sidewall of the bobbin case, the two parts of the looper forming a closed bobbin housing are now no longer inserted one in the other in telescope fashion, but are fitted together on the pot and lid principle. With the interior thus increased in radial direction, an especially great eccentric offset of the pin hence of the bobbin case becomes possible, and this in turn makes it possible to form the rear region of the bobbin case holder as a truncated cone extending eccentrically to the guide rib. This design of the bobbin case holder results in a wide thread guiding shoulder extending obliquely under a comparatively especially acute angle to the plane of the guide rib. By the further measure of forming the front end face of the bobbin case as a cap arched in mushroom form and radially protruding over the sidewall, with at least the initial region of its edge section lying on the side of the downwardly directed part of the track of the rotary hook tip lying at least in the plane, but better behind the plane of the movement path of the front end of the thread deflecting shoulder of the looper body, there is created, in conjunction with the thread guiding shoulder of the bobbin case holder, in the region in which the needle thread loop is expanded, a cuneiform cross section of the bobbin housing which greatly improves the sewing property of the rotary hook. The wide thread guiding shoulder, extending under an especially acute angle, on the back of the bobbin case holder and the arched front endwall of the bobbin case thus permit a considerable axial enlargement of the bobbin housing and hence, as compared with conventional rotary hook of equal outside diameter, an increase of the rotary hook thread uptake capacity of approximately 50%, while yet ensuring, even at high sewing speeds, a uniform expansion of the needle thread loop and a joltless sliding of the respective leg of the needle thread loop onto the front endwall of the bobbin case.

By the especially eccentric offset of the bobbin case, the bobbin is furthermore shifted so far downward that the needle will not stab into the thread coil even when the bobbin is completely full.

As the rotary hook of the invention has the same outside diameter as a conventional rotary hook and moreover the rotary hook body of conventional rotary hooks can even be taken over unchanged, also the position of the rotary hook shaft may remain unchanged. This simplifies the manufacture of the machine housing and of the drive mechanism parts, and in addition, in older sewing machines equipped with a conventional rotary hook, it becomes possible to exchange the bobbin housing for a new one with increased rotary hook thread uptake capacity. Another result of the unchanged outside diameter is that the thread cutting devices and case lifter developed for the old rotary hooks can be used without modifications.

Because the bobbin housing formed by the bobbin case holder and bobbin case embraces the bobbin especially closely, only slightly more needle thread is pulled under the throat plate when guiding the loop around the housing than with a conventional rotary hook, despite the axial enlargement of the bobbin case. This slightly larger amount of thread does not yet require the use of a different thread feeder with accordingly adapted characteristic, it can be handled with a conventional thread feeder, the extra thread being furnished by an appropriate adjustment of a thread eye arranged next to the movement path of the thread feeder.

With the further development of the rotary hook, a transition from the bobbin case holder to the bobbin case on a smooth surface and hence jolt-free for the needle thread loop is provided. This contributes to more uniform thread tension values as the needle thread loop is being placed around the bobbin housing and so improves the sewing properties of the rotary hook at high sewing speeds.

To accommodate the thread tension spring on the sidewall of the bobbin case, the cap thereof is provided with a recess concentric to the sidewall. Thus the thread tension spring used in conventional rotary hooks can be taken over unchanged.

If the rotary hook is operated with a case lifter, the bobbin case is designed so that the edge section of the cap ascends in axial direction on the side of the bobbin case on which the needle thread loop is expanded. The axially ascending edge section is limited by a cutout, whereby an abutment surface for the finger of the case lifter is formed on the bobbin case. The gradual axial ascent of the edge section thus ensures also when using a case lifter a uniform, joltless widening of the needle thread loop. Because the abutment surface is formed on the bobbin case rather than being formed by a projection on the bobbin case holder protruding over the edge of the bobbin case, as is generally the case in conventional rotary hooks, disturbances which could otherwise occur as the needle thread loop slides onto the projection on the bobbin case holder are precluded from the start.

The enlargement of the needle thread loop caused by the axial ascent of the edge section of the bobbin case can be compensated, by the fact that the abutment surface for the finger of the case lifter, forming the lowest point of the bobbin case, lies laterally spaced in front of a vertical line passing through the axis of the guide rib.

Accordingly, it is an object of the invention to provide an improved rotary hook for a sewing machine which can be used with the existing conventional machines and which is constructed to permit exchange of the bobbin housing with one of increased rotary hook thread uptake capacity and which engages the thread to pull it out in greater loop formation without any thread feeding difficulty.

A further object of the invention is to provide a sewing machine having a bobbin which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 4 shows a front view of the bobbin case holder;

FIG. 5 shows a front view of the bobbin case;

FIG. 6 shows a side view of the bobbin case holder;

FIG. 7 shows a side view of the bobbin case;

FIG. 8 shows a top view of the bobbin case holder;

FIG. 9 shows a top view of the bobbin case;

FIG. 10 shows a sectional representation of the bobbin case holder and of the bobbin case along line X—X of FIG. 2;

FIG. 11 shows a front view of the rotary hook with a partially expanded needle thread loop FIG. 12 shows a front view of another embodiment of the rotary hook designed for operation with a case lifter;

FIG. 13, is a side view of the bobbin case of the rotary hook according to FIG. 12 viewed from the left; and FIG. 14 is a side view of the bobbin case of the rotary hook according to FIG. 12 viewed from the right.

DESCRIPTION OF THE PREFERRED EMBODIMENTS

Figure 1:
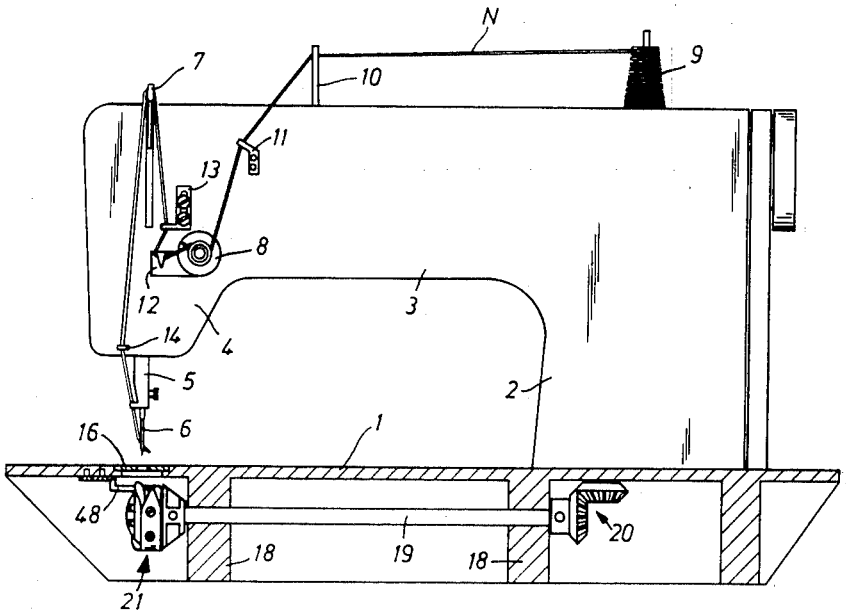
FIG. 1 shows a partial side elevational and sectional view of a sewing machine having a rotary hook constructed in accordance with the invention.

The housing of the sewing machine illustrated in FIG. 1 comprises a base plate 1, a standard 2, an arm 3, and a head 4. In head 4, a needle bar 5, moving upwardly and downwardly is mounted in a known manner, carries a needle 6. In head 4 is arranged further a lever type thread feeder 7 movable upwardly and downwardly in known manner. At head 4 is attached a thread tensioning device 8 for the needle thread N. For guiding the needle thread N drawn from a supply spool 9, there serves a guide pin 10 and a thread eye 11. Between the thread tensioning device 8 and the thread feeder 7, two additional thread eyes 12,13 are arranged, of which the upper 13 is adjustable in vertical direction. From the thread feeder 7 the needle thread N runs via an additional thread eye 14 to the eye 15 (FIG. 2) of needle 6.

In the base plate 1, a throat plate 16 is arranged, which is provided with a hole 17 for passage of the needle 6. Below the base plate 1, in bearing ribs 18, (FIG. 1) a shaft 19 is mounted, one end of which is connected through a bevel gear drive 20 with the main shaft, not shown, of the sewing machine, and the other end of which carries a freely revolving rotary hook 21 for the formation of double lockstitches. Rotary hook 21 has the same outside diameter as conventional rotary hooks and is driven in the ratio 2:1, that is, it executes two revolutions during each movement cycle of the needle bar 5.

Figure 2:
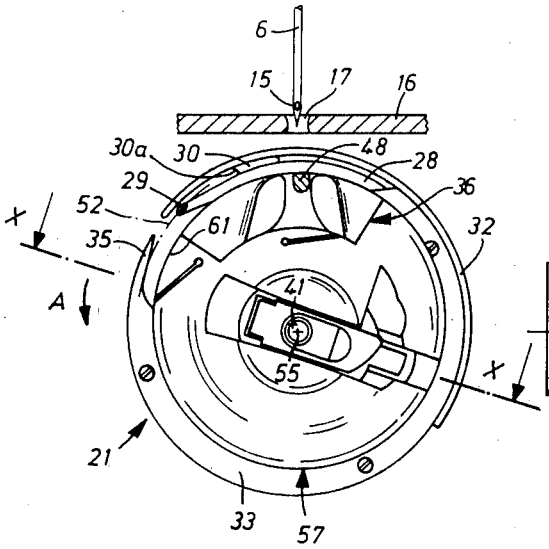
FIG. 2 shows a front view of the rotary hook.
Figure 3:
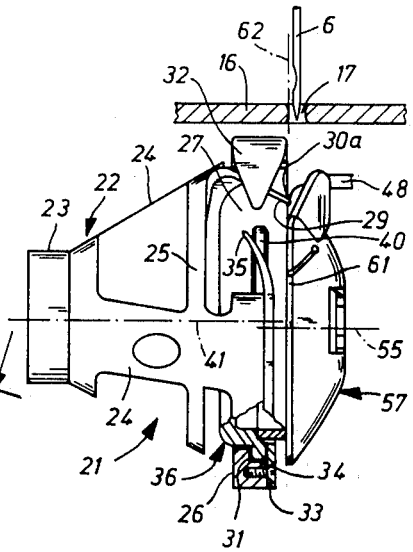
FIG. 3 shows a side view of the rotary hook.

Rotary hook 21 contains a rotary hook body 22 secured on shaft 19, and which comprises a flange 23, several webs 24, a bottom 25, and a support ring 26 as shown in FIGS. 2 and 3. Support ring 26 is interrupted by a cutout 27. Adjacent one end of support ring 26 is an axially projecting projection 28, on which are formed a looper tip 29 and an obliquely extending thread deflecting shoulder 30, the front end of which is marked 30*a*. In support ring 26, starting from the end face thereof, an annular cutout 31 concentric with shaft 19 is contained, terminating inside projection 28 in a groove of rectangular cross section, not shown.

On the circumference of support ring 26 a thread puller 32 is secured which covers approximately one half of the support ring 26. The thread puller 32 extends over the thread deflecting shoulder 30 and protrudes with a radial spacing over a part of the looper tip 29. On the end face of support ring 26 an annular covering segment 33 is screwed on, which laterally closes the cutout 31 and forms with it an annular groove 34. One end of segment 33 borders on projection 28, while the other end is formed as a catcher tip 35 protruding into cutout 27.

Inserted in the rotary hook body 22 is a bobbin case holder 36, which is rotatable therein, and which has a bottom 37 and an annular sidewall 38 as shown in FIGS. 4 and 6. On the outer side of sidewall 38 an annular guide rib 40 interrupted by a cutout 39 is formed, which is disposed inside the annular groove 34 of rotary hook body 22 and whose axis is marked 41. The front endwall face 42 of guide rib 40 lies essentially in the same plane as the end face 43 of sidewall 38.

The bobbin case holder 36 comprises a projection 44 having two radially extending limiting faces 45,46 and projecting axially over the guide rib 40. On the front side of projection 44 a recess 47 for a stop finger 48 fastened to the base plate 1 is formed, which secures the bobbin case holder 36 against rotation. A slot 49 for passage of the needle 6 is provided in projection 44 according to FIG. 8.

The rear region of the bobbin case holder 36 is formed as a truncated cone 50 which is eccentric to the guide rib 40 and whose axis 51 is displaced downward relative to axis 41 of guide rib 40 according to FIG. 6 and laterally to the right according to FIG. 8. Due to the lateral displacement, the axis 51 lies on the side of the upwardly directed part of path 52 of rotary hook tip 29, the running direction of which is marked by arrow A in FIG. 2. The truncated cone 50 forms on the back of bobbin case holder 36 a thread guiding shoulder 53, the greatest width of which lies in the upper section of the downwardly directed part of path 52 of rotary hook tip 29.

Fastened on bottom 37 of bobbin case holder 36 is a pin 54, the axis 55 of which is likewise displaced downwardly relative to axis 41 of guide rib 40 according to FIG. 6 and, according to FIG. 8, with a lateral spacing to the side of the upwardly directed part of path 52 of looper tip 29. At the free end of pin 54 an annular groove 56 is formed.

Rotary hook 21 further comprises a bobbin case 57 which consists of a sleeve 58 to be fitted onto pin 54, of a cap 59 forming the front end closure of bobbin case 57, and of an annular sidewall 60. The sidewall 60 of bobbin case 57 is aligned with the sidewall 38 of bobbin case holder 36. Cap 59 is arched in mushroom form and protrudes radially beyond the sidewall 60. The edge section 61 of cap 59 is essentially concentric with guide rib 40 and lies in plane 62, shown in FIG. 3, of the movement path of the front end 30*a* of the thread deflecting shoulder 30. In cap 59 and sidewall 60, a segment type cutout 63 with radially extending limiting edges 64 and 65 is contained, to receive the projection 44.

Cap 59 of bobbin case 57 is provided with a recess 66 concentric with sidewall 60. On sidewall 60 a thread tensioning spring 67 partly protruding into recess 66 is arranged, as seen in FIG. 9. In cap 59, two thread guiding slits 68 and 69 for the bobbin thread G are provided. In a guide slit 70 running diagonally in cap 59 a spring supported latch 71 is arranged, which is provided with an oblong hole 72 for passage of the free end of pin 54 and which carries a pivotable flap 73 serving to shift latch 71. The bobbin case holder 36 and bobbin case 57 together form a bobbin housing 74 (FIG. 10) which closely embraces the bobbin 75 placed on sleeve 58. Bobbin 75 has two flanges 101 and 102.

The bobbin case 57 and the case holder 36 together have an axial length, so that the plane of movement of the needle 6 extends between the flanges 101 and 102 of the bobbin 75 which is rotatably received on the hollow sleeve 58 of the bobbin case 57.

The rotary hook 76 shown in FIG. 12 is operated in conjunction with a case lifter 77. Case lifter 77 comprises a finger 79 attached on a lever 78. Lever 78 is arranged on a stud 80 and connected with an eccentric rod 81 which engages around an eccentric 83 secured on a driven shaft 82.

Rotary hook 76 is essentially identical with looper 21, i.e. the rotary hook body and the bobbin case holder are of the same design as the hook body 22 and bobbin case holder 36 of rotary hook 21. Only the bobbin cases 57 and 84 of the two rotary hooks are different.

Just as bobbin case 57, the bobbin case 83 includes a sleeve 85, a cap 86, and an annular sidewall 87. In cap 86 and in sidewall 87 a segment shaped cutout 88 is contained. The edge section 89 of cap 86, which again is arched in mushroom form and protrudes radially beyond the sidewall 87, ascends, starting from cutout 88 on the side of the downwardly directed part of path 90 of the rotary hook tip 91 in axial direction and is limited by a cutout 92. In this case the edge section 89 has a wedge shaped surface 93. The substantially radial limiting surface 94 formed by cutout 92 constitutes an abutment surface for finger 79 of case lifter 77. The limiting face 94 lies, viewed in running direction A of rotary hook 76, laterally spaced in front of a vertical line 98 passing through axis 95 of guide rib 96 of bobbin case holder 97.

In the case of rotary hook 76, only the portion of the edge section 89 adjacent cutout 88 lies in the plane, not shown, of the movement path of the front end of the thread deflecting shoulder 99.

The mode of operation of rotary hook 21 is essentially the same as that of conventional double lockstitch rotary hooks. Accordingly, referring to FIG. 11, the rotary hook tip 29 revolving in direction A seizes the loop S of needle thread N formed by needle 6 in known manner, expanding it. During expansion the loop S is rotated by 180°, whereby leg NN connected with the work is pulled by the thread deflecting shoulder 30 over the edge section 61 onto cap 59 and hence onto the front endwall of bobbin case 57. Meanwhile the leg NV of loop S connected with the supply spool 9 (FIG. 1) runs from cutout 39 of guide rib 40 along the rear side of bobbin case holder 36 (FIGS. 7 and 8).

An essential prerequisite for uniform, joltless expanding and laying of loop S is provided by the cuneiform cross section of the bobbin housing 74, which cross section is formed on the one hand by the thread guiding shoulder 53 at bobbin case holder 36 extending obliquely at an acute angle to the plane of the guide rib 40 and also by the mushroom cap 59 at the front endwall of bobbin case 57. Another important prerequisite is fulfilled by the fact that the edge 61 of the bobbin case 57 lies in the plane 62, shown in FIG. 3, of the movement path of the front end 30*a* of the thread deflecting shoulder 30, so that leg NN of loop S can slide onto cap 59 of bobbin case 57 unhindered. These measures bring about, despite the fact that the rotary hook thread uptake capacity is increased by approximately 50% over conventional rotary hooks of equal outside diameter, a good sewing result. After loop S has been passed around the lowest point of the bobbin housing 74 and thereafter snaps off the thread deflecting shoulder 30, the thread feeder 7 pulls the released loop S up again. Although in the case of rotary hooks 21, a slightly greater amount of needle thread N is pulled under the throat plate 16 due to the bobbin housing 74 being axially enlarged as compared with conventional rotary hooks, a thread feeder designed for sewing machines with conventional rotary hooks can be used all the same. The extra amount of needle thread N needed can be supplied by lowering the position of the thread eye 13 arranged next to the movement path of the thread feeder 7.

The mode of operation of rotary hook 76 is essentially identical with that of rotary hook 21. One difference is that the loop S, on being passed around the bobbin case 84 and bobbin case holder 97 and as it is reaches the limiting face 94, snaps into the cutout 92 and is then pulled through between bobbin case 84 and finger 79. Thereafter the bobbin case 84 and bobbin case holder 97 are moved by filter 77 in known manner by a small angle counter to the running direction A of rotary hook 76, whereby a gap is created between stopping finger 48 and the limiting face 100 of bobbin case holder 97 associated with it, for the unhindered pulling up of loop S. Because the limiting face 94 and hence the lowest point of bobbin case 84 is located laterally spaced in front of the vertical line 98 passing through axis 95 of guide rib 96, the same amount of needle thread is pulled under the throat plate, 16 as the rotary hook of the needle thread is being laid in the case of rotary hook 76 as in the case of rotary hook 21, despite the axially ascending edge section 89.

While specific embodiments of the invention have been shown and described in detail to illustrate the application of the principles of the invention, it will be understood that the invention may be embodied otherwise without departing from such principles.

We claim:

1. A rotary hook for a sewing machine having a rotary hook drive shaft for driving a rotary hook body in cooperation with a reciprocating reciprocatig needle which moves toward and away from the rotary hook in a needle movement plane, comprising:

a rotary hook body having a revolving hook tip movable in a path below the needle and engageable with a thread presented by the needle to catch a needle thread loop, said path having an upwardly directed portion near the needle and a downwardly directed portion away from the needle, said rotary hook body having a thread deflecting shoulder for forming the needle loop and having an annular groove defined therein;

a bobbin case holder having an annular guide rib disposed in said annular groove of said rotary hook body for supporting said bobbin case holder on said rotary hook body;

a pin extending axially outwardly from said bobbin case holder;

a bobbin case having a central hollow sleeve into which said pin extends and onto which a bobbin having a pair of axially spaced flanges is rotatably receivable;

means for holding said bobbin case holder against rotation;

said bobbin case and said case holder together having an axial length so that the plane of movement of the needle extends between flanges of a bobbin rotatably received on said hollow sleeve;

said case holder and said bobbin case having annular side walls which are in substantial axial alignment with each other and which engage each other to form a space for a bobbin received on said hollow sleeve;

said bobbin case holder having a rear wall closing said space, said bobbin case holder side wall connected to said rear wall and at least partly having the shape of a truncated cone which is eccentric with respect to said guide rib, an axis of said truncated cone and an axis of said pin lying below and laterally of an axis of said guide rib on one side of the upwardly directed portion of the path of said hook tip;

said bobbin case having its annular side wall extending toward said case holder from said needle movement path, and having a front end wall for closing said space which has an arched mushroom shape, said front end wall having a peripheral annular edge portion which extends axially to the plane of movement of the thread deflecting shoulder of said rotary hook body which plane of movement lies on a side of said needle movement plane closest to said rotary hook body, said bobbin case front end wall comprising a cap having a recess concentric with said sidewall of said bobbin case and a thread tensioning spring in said recess.

* * * * *